US007612730B2

(12) United States Patent
Lim et al.

(10) Patent No.: US 7,612,730 B2
(45) Date of Patent: Nov. 3, 2009

(54) ANTENNA SYSTEM AND ANTENNA THEREOF

(75) Inventors: Chan-Ping Lim, San Diego, CA (US); Tsung-Ying Tsai, Yanchao Town (TW)

(73) Assignee: YFY RFID Technologies Company Limited, Tortola (VG)

( * ) Notice: Subject to any disclaimer, the term of this patent is extended or adjusted under 35 U.S.C. 154(b) by 0 days.

(21) Appl. No.: 12/057,848

(22) Filed: Mar. 28, 2008

(65) Prior Publication Data

US 2009/0195469 A1 Aug. 6, 2009

(30) Foreign Application Priority Data

Jan. 31, 2008 (TW) ..... 097103700

(51) Int. Cl.
*H01Q 13/10* (2006.01)

(52) U.S. Cl. ..... 343/770; 343/767; 343/700 MS

(58) Field of Classification Search ..... 343/770, 343/767, 768, 769, 700 MS
See application file for complete search history.

(56) References Cited

U.S. PATENT DOCUMENTS

| | | | | |
|---|---|---|---|---|
| 4,903,033 | A | 2/1990 | Tsao et al. | |
| 4,916,457 | A | 4/1990 | Foy et al. | |
| 5,187,490 | A * | 2/1993 | Ohta et al. | 343/770 |
| 5,241,321 | A | 8/1993 | Tsao | |
| 5,448,250 | A | 9/1995 | Day | |
| 5,581,266 | A * | 12/1996 | Peng et al. | 343/770 |
| 5,633,645 | A | 5/1997 | Day | |
| 6,018,319 | A | 1/2000 | Lindmark | |
| 6,304,226 | B1 | 10/2001 | Brown et al. | |
| 6,339,406 | B1 | 1/2002 | Nesic et al. | |
| 6,445,346 | B2 | 9/2002 | Fathy et al. | |
| 6,452,552 | B1 | 9/2002 | Ishitobi et al. | |
| 6,507,320 | B2 | 1/2003 | Von Stein et al. | |
| 6,646,618 | B2 | 11/2003 | Sievenpiper | |
| 7,091,920 | B2 * | 8/2006 | Yuanzhu | 343/770 |
| 7,126,549 | B2 | 10/2006 | Li et al. | |
| 2004/0066345 | A1 * | 4/2004 | Schadler | 343/767 |
| 2006/0077113 | A1 * | 4/2006 | Yuanzhu | 343/770 |

* cited by examiner

*Primary Examiner*—Tho G Phan
(74) *Attorney, Agent, or Firm*—Holland & Knight LLP; Brian J. Colandreo, Esq.

(57) ABSTRACT

An antenna system and an antenna thereof are provided. The antenna system comprises an antenna array including a plurality of antennas and at least one plate. The at least one plate is used for isolating two neighbor ones of the antennas. Each of the antennas comprises a first surface and a second surface. The first surface has a metal area and a slot area. The metal area is coated by a metal material, while the slot area consists of three slots. Each of the slots comprises a first area and a second area. The first areas are connected to each other, and each of the second areas extends to different directions individually. The second surface is coated by a metal line as a signal feed end. The metal line terminates at an opposite position of a signal feed slot, which is one of the three slots.

20 Claims, 7 Drawing Sheets

ANTENNA SYSTEM AND ANTENNA THEREOF

RELATED APPLICATION

This application claims the benefit from the priority of Taiwan Patent Application No. 097103700, filed on Jan. 31, 2008, the contents of which are herein incorporated by reference in its entirety.

BACKGROUND OF THE INVENTION

1. Field of the Invention

The present invention relates to an antenna system and an antenna thereof. More particularly, the present invention relates to an antenna system comprising a plurality of antennas, and the antenna thereof, wherein each of the antennas has a slot area with a Y-shaped or T-shaped geometric profile.

2. Descriptions of the Related Art

Radio frequency identification (RFID), one solution of automatic identification technologies, relies on radio frequency (RF) electromagnetic waves to communicate between an RFID tag and a transmitter or a reader. In some applications, the transmitter and the reader are combined into a single device. An RFID tag is a small object attached to or implanted in an article, an animal's or a person's body for identification purpose, and carries information of the article, the animal or the person. To obtain such information, a reader should be installed at a nearby location to receive RF electromagnetic waves transmitted from the RFID tag so as to retrieve information corresponding to the article, the animal or the person from the RF electromagnetic waves. Some technologies currently available may support the communication between the RFID tag and reader or a transmitter several meters away from each other. The RFID is used in a variety of applications which requires the wireless identification or recording for articles. One of these applications is the checkout system in a supermarket.

There are two categories for RFID systems in terms of reading distance. One is the near-field RFID that reads the information by using magnetic field induction within a distance of centimeters. The other one is the far-field RFID that reads the information by using electric field induction within a distance ranging from several to tens of meters. For the checkout system, sensing RFID tags and reading information need to be performed non-directionally in a limited space. Hence, a near-field RFID is generally adopted in the checkout system.

As shown in FIG. 1, an antenna 1 used in a near-field RFID to detect RFID tags comprises a metal area 11 and a slot area 13. The metal area 11 is coated by a metal material. The slot area 13 allows electromagnetic waves to pass through and generate a magnetic field to detect the RFID tag. Dimensions of the slot area 13 are associated with an operating frequency band of the RFID system. More specifically, with adjusting the dimensions of the slot area 13, the antenna 1 will operate at different frequency bands ranging from 880 MHz to 960 MHz. Due to the geometric profile of the slot area 13 shown in FIG. 1, the magnetic field generated by electromagnetic waves passing through the slot area 13 only can detect the RFID tag in a single direction. For example, when an article passes through the antenna 1 along the Y axis direction, the antenna 1 is able to detect the RFID tag attached thereon and successfully read the information. However, if the article passes through the antenna 1 along the X axis direction instead, the antenna 1 fails to detect the RFID tag. Consequently, the information in the RFID tag cannot be read.

Therefore, many inconveniences may exist when using the antenna 1 shown in FIG. 1 to detect RFID tags. Furthermore, if the antenna 1 in FIG. 1 is used for detecting RFID tags in a supermarket, customers have to line up all goods with RFID tags thereon facing the same direction when checking out. Otherwise, checkout errors will occur if any RFID tag is not detected.

In view of this, it is highly desirable in the art to design an antenna system capable of reading an RFID tag in any directions.

SUMMARY OF THE INVENTION

One objective of this invention is to provide an antenna capable of reading an RFID tag in any directions. The antenna comprises a first surface and a second surface. The first surface has a metal area and a slot area. The metal area is coated by a metal material, and the slot area consists of three slots. Each of the slots defines a first area and a second area. The first areas are connected to each other, and each of the second areas extends to different directions individually. The second surface opposite to the first surface is coated by a metal line as a signal feed end. The metal line terminates at an opposite position of a signal feed slot, which is one of the three slots.

Another objective of this invention is to provide an antenna system capable of reading an RFID tag in any directions. The antenna system comprises an antenna array having a plurality of antennas and at least one plate isolateing two neighbor ones of the antennas. The above-disclosed antenna is adopted as each of the antennas in the antenna system.

Because the three slots in the slot area of the antenna of this invention are connected to each other but extended toward different directions individually, the magnetic field they generate will be distributed in more than one direction. In other words, the antenna and the antenna system of this invention are capable of detecting RFID tags in any directions within their reading range thereof. Accordingly, the present invention solves the problem of the prior art.

The detailed technology and preferred embodiments implemented for the subject invention are described in the following paragraphs accompanying the appended drawings for people skilled in this field to well appreciate the features of the claimed invention.

DESCRIPTION OF THE PREFERRED EMBODIMENT

Figure 1:
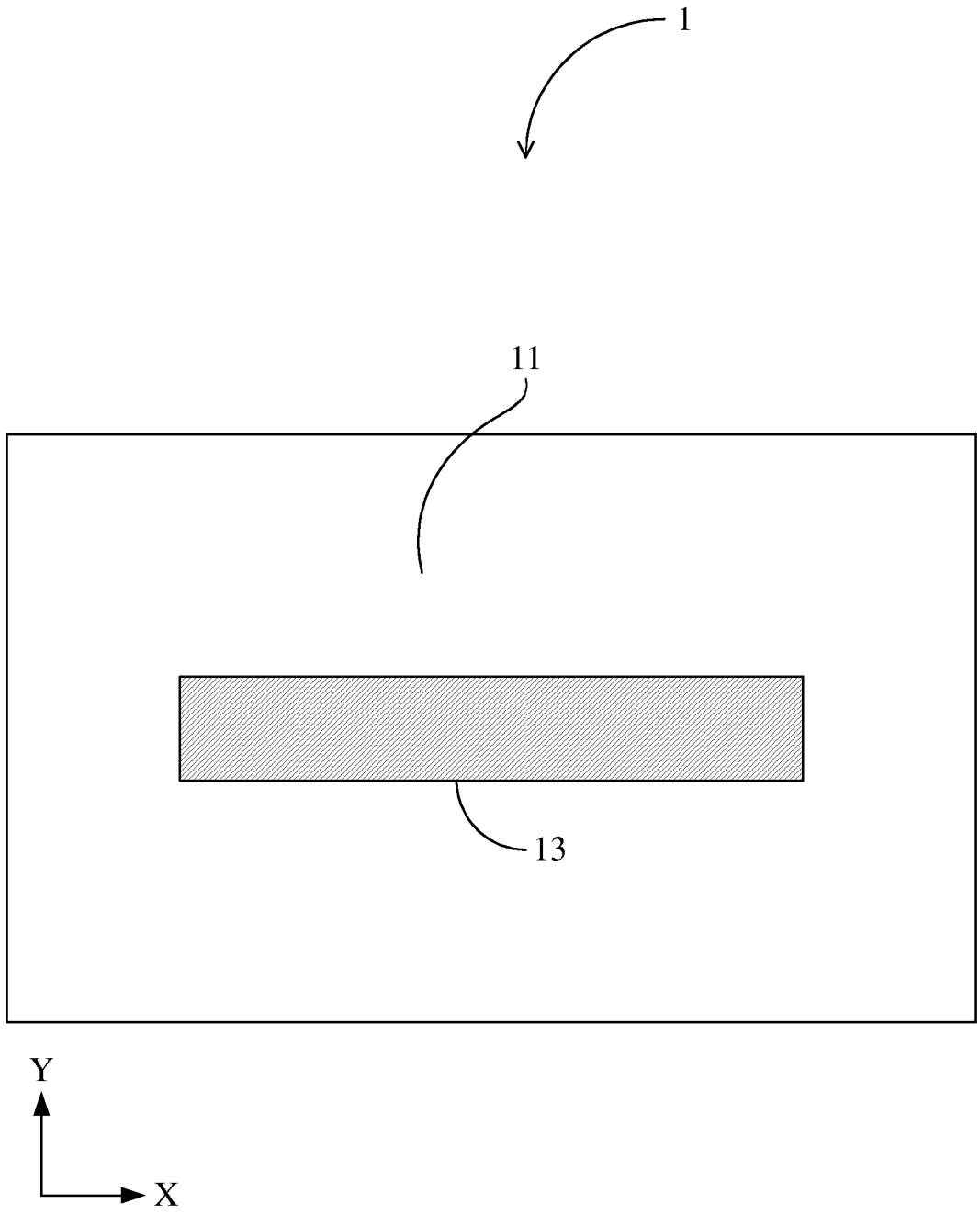
FIG. 1 (Prior Art)
FIG. 1 is a schematic diagram illustrating a typical antenna for a near-field RFID.
Figure 2:
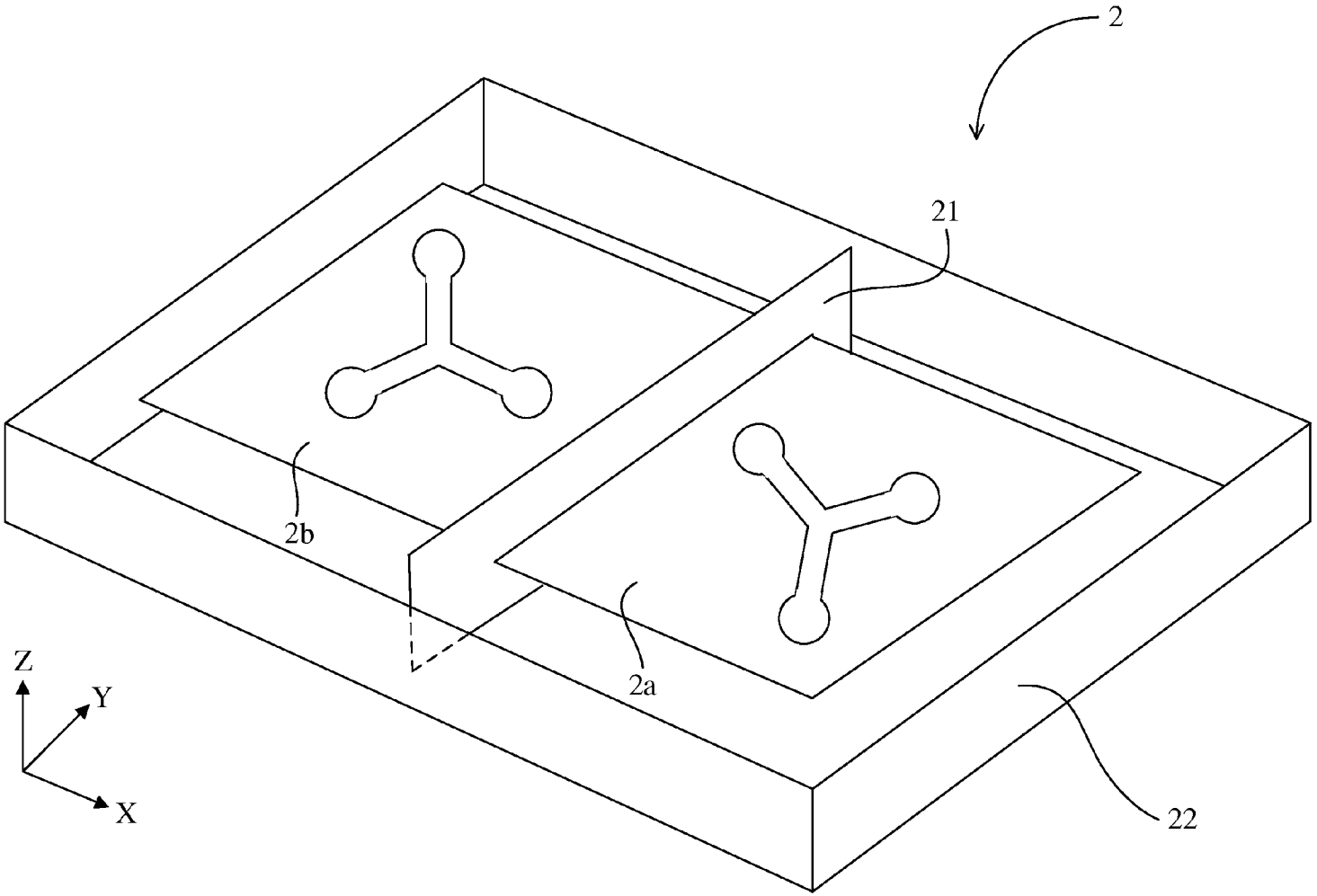
FIG. 2 is a schematic diagram illustrating a first embodiment of this invention.

As shown in FIG. 2, the first embodiment of this invention is an antenna system 2. The antenna system 2 comprises an antenna array, a plate 21 and a case 22. The antenna array has a plurality of antennas. In this embodiment, the antenna array has two antennas 2*a*, 2*b*. The plate 21, made of a metal material, isolates the antennas 2*a*, 2*b* to prevent the electromagnetic waves of the antennas 2*a*, 2*b* from interfering with each other so that the performance of the antenna system 2 would not be affected. It should be noted that since the antenna array in this embodiment has two antennas 2*a*, 2*b*, only one plate 21 is needed to isolate two antennas. However, this invention has no limitation on the number of antennas included in the antenna array. The number of plates varies accordingly depending on the number of antennas in the antenna array. For example, if the antenna array has four antennas arranged in a 2*2 matrix, two plates will be needed in the antenna system 2 to isolate these antennas from each other. Those skilled in the art can optionally increase the number of antennas in the antenna system, and adjust the number and locations of plates according to the arrangement of the antennas in the antenna system. Thus, the arrangement will not be further described herein.

The case 22 accommodates the antenna array and the plate 21. The antenna system 2 defines a signal shield direction and a signal passing direction. In this embodiment, the antenna system 2 defines an upward direction, i.e., the positive Z axis direction as the signal passing direction. The other directions are defined as the signal shield direction. Accordingly, the part of the case in the signal shield direction (positive and negative X axis directions, positive and negative Y axis directions, and negative Z axis direction) is made of a metal material. That is, the four side walls and the bottom surface of the case 22 are made of a metal material. The other part of the case 22 in the signal passing direction (positive Z axis direction) is made of a non-metal material. That is, the top surface of the case 22 is made of a non-metal material. For the sake of illustration, the top surface of the case 22 is not shown in the figure so that the interior of the antenna system 2 can be exposed.

Figure 2A:
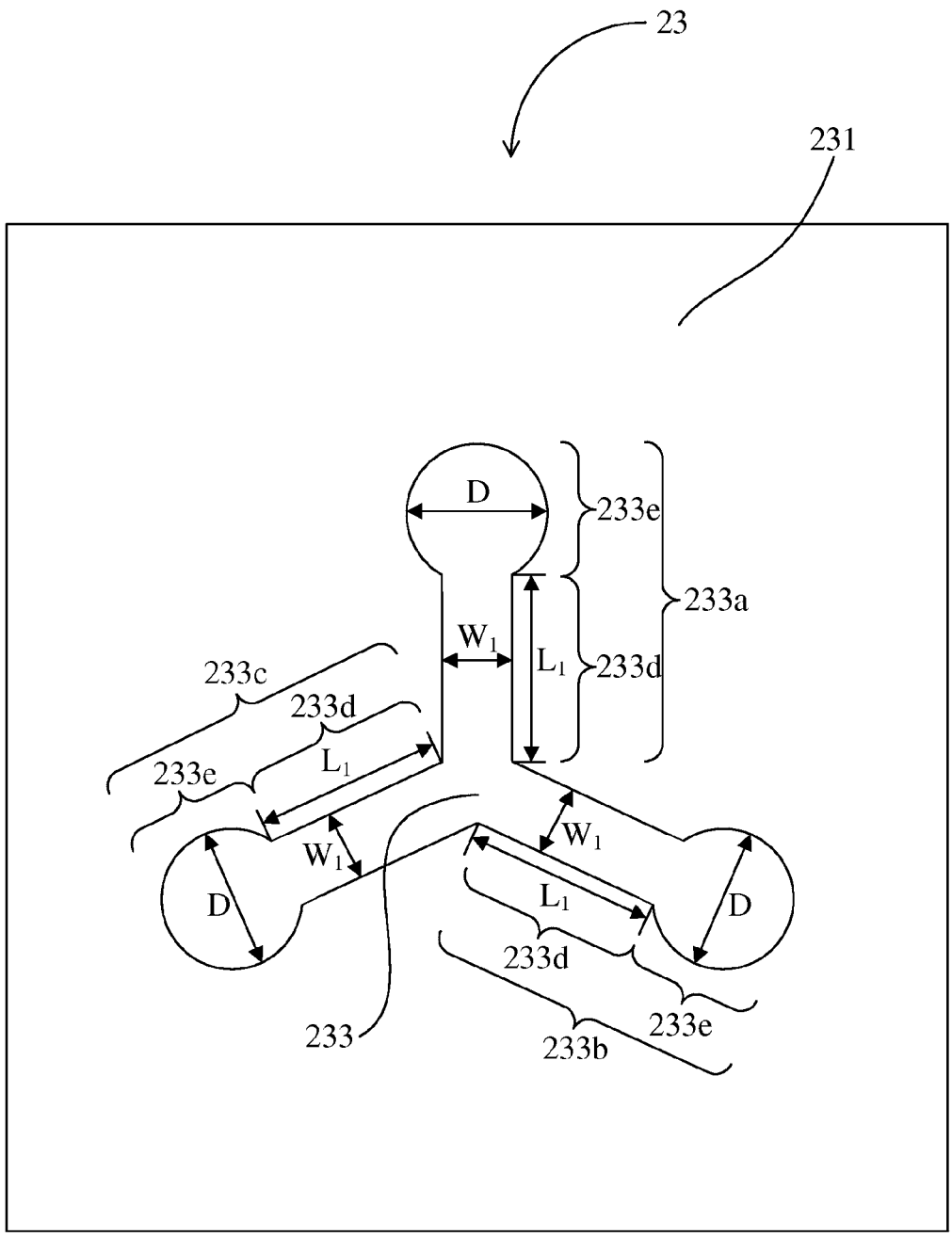
FIG. 2A is a schematic diagram illustrating the first surface of the antenna in accordance with the first embodiment.
Figure 2B:
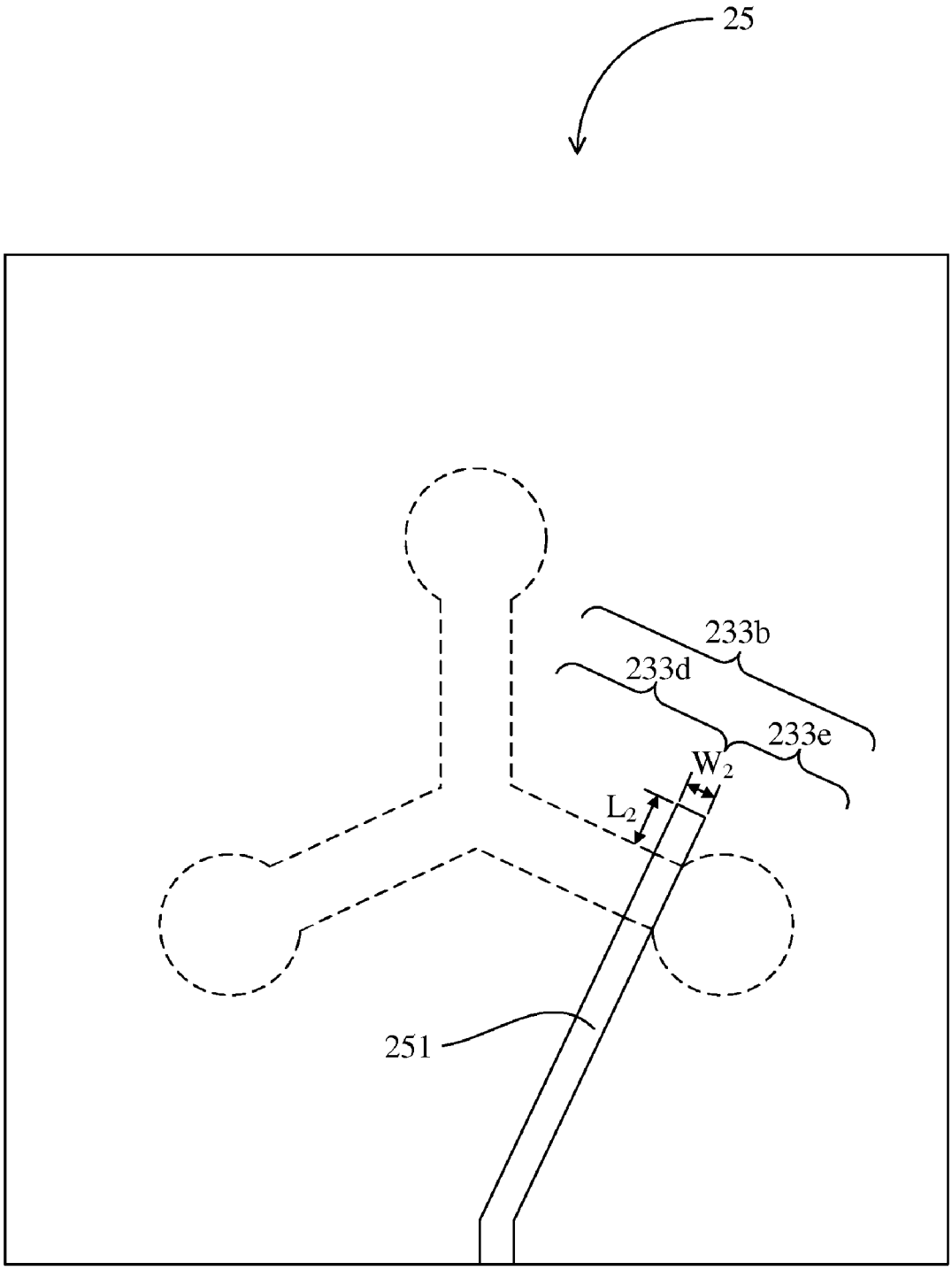
FIG. 2B is a schematic diagram illustrating the second surface of the antenna in accordance with the first embodiment.

As shown in FIGS. 2A and 2B, the antennas 2*a*, 2*b* both have a first surface 23 and a second surface 25 opposite to the first surface 23. In this embodiment, the first surface 23 faces the signal passing direction (positive Z axis direction), while the second surface 25 faces one of the signal shield directions (negative Z axis direction). As shown in FIG. 2A, each of the first surfaces 23 of the antennas 2*a*, 2*b* comprises a metal area 231 coated by a metal material, and a slot area 233. The slot area 233 consists of three slots 233*a*, 233*b*, 233*c*, each of which defines a first area 233*d* and a second area 233*e*. The first areas 233*d* of the three slots 233*a*, 233*b*, 233*c* are connected with each other at one end. The second areas 233*e* extend toward different directions individually. In this embodiment, every two adjacent ones of the slots 233*a*, 233*b*, 233*c* have an included angle of 120 degrees, thus yielding a Y-shaped geometric profile.

In this embodiment, the three slots 233*a*, 233*b*, 233*c* all have the same shape. Each of the first areas 233*d* is shaped as a rectangle, while each of the second area 233*e* is shaped as a circle. For an application involving a frequency band from 880 MHz to 960 MHz, the rectangle has a length L1 ranging from 20 mm to 21 mm, and a width W1 ranging from 7 mm to 8 mm. The length L1 is preferred to be 20.664 mm. The width W1 is preferred to be 7.7 mm. The circle has a radius ranging from 8 mm to 10 mm, i.e., a diameter D ranging from 16 mm to 20 mm. The preferred radius is 8.8 mm. It should be particularly noted that the size of the three slots 233*a*, 233*b*, 233*c* is not limited to what described above. Those skilled in the art may make appropriate modification on the dimensions, ratios and extension directions thereof depending on the required operating frequency band of the antenna system 2.

As shown in FIG. 2B, the second surface 25 of each of the antennas 2*a*, 2*b* is coated by a metal line 251 as a signal feed end. For the purpose of illustration, the relative position of the slot area 233 is also depicted in FIG. 2B in dashed lines. The metal line 251 terminates at an opposite position of a signal feed slot, which in this embodiment is the slot 233*b*. More specifically, the metal line 251 terminates on the other surface of an intersection between the first area 233*d* and the second area 233*e* of the slot 233*b*, and protrudes beyond the intersection. Since a signal source transmits signals through the metal line 251, any impedance mismatch between the signal source and the metal line 251 would cause a loss in energy. In this embodiment, if the signal source has an impedance of 50 ohm (Ω), the width W2 of the metal line 251 is substantially between 2.5 mm and 3.5 mm. The preferred width is 3 mm. A length L2 by which the metal line 251 protrudes beyond the opposite position is from 5.5 mm to 9 mm, and is preferably 5.9 mm.

Figure 3:
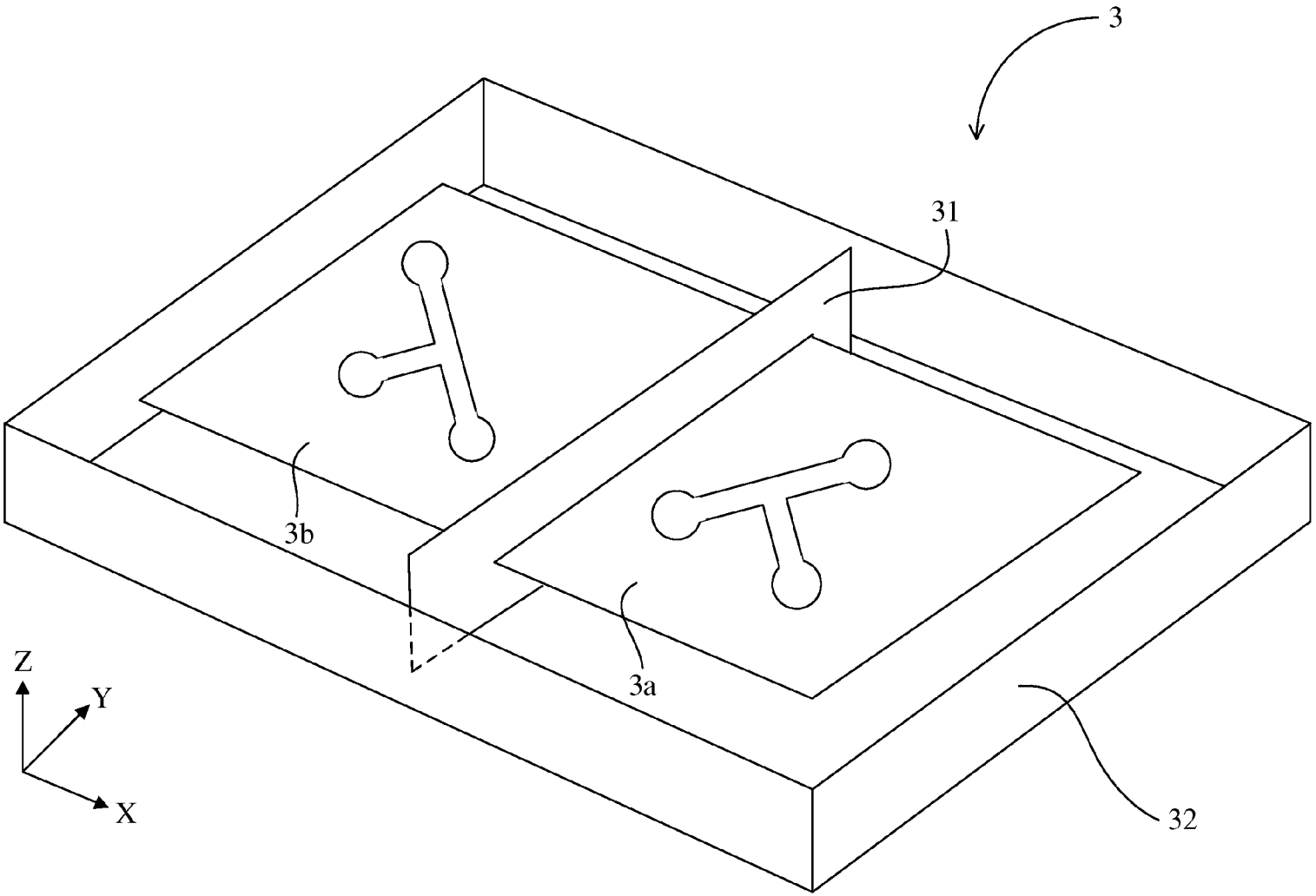
FIG. 3 is a schematic diagram illustrating a second embodiment of this invention.

FIG. 3 depicts an antenna system 3 in accordance with the second embodiment of this invention. Unlike the antenna system 2 described above in the first embodiment, the antenna system 3 has an antenna array comprising different antennas 3*a*, 3*b*. In particular, the antennas 3*a*, 3*b* have slot areas in a T-shaped geometric profile.

Figure 3A:
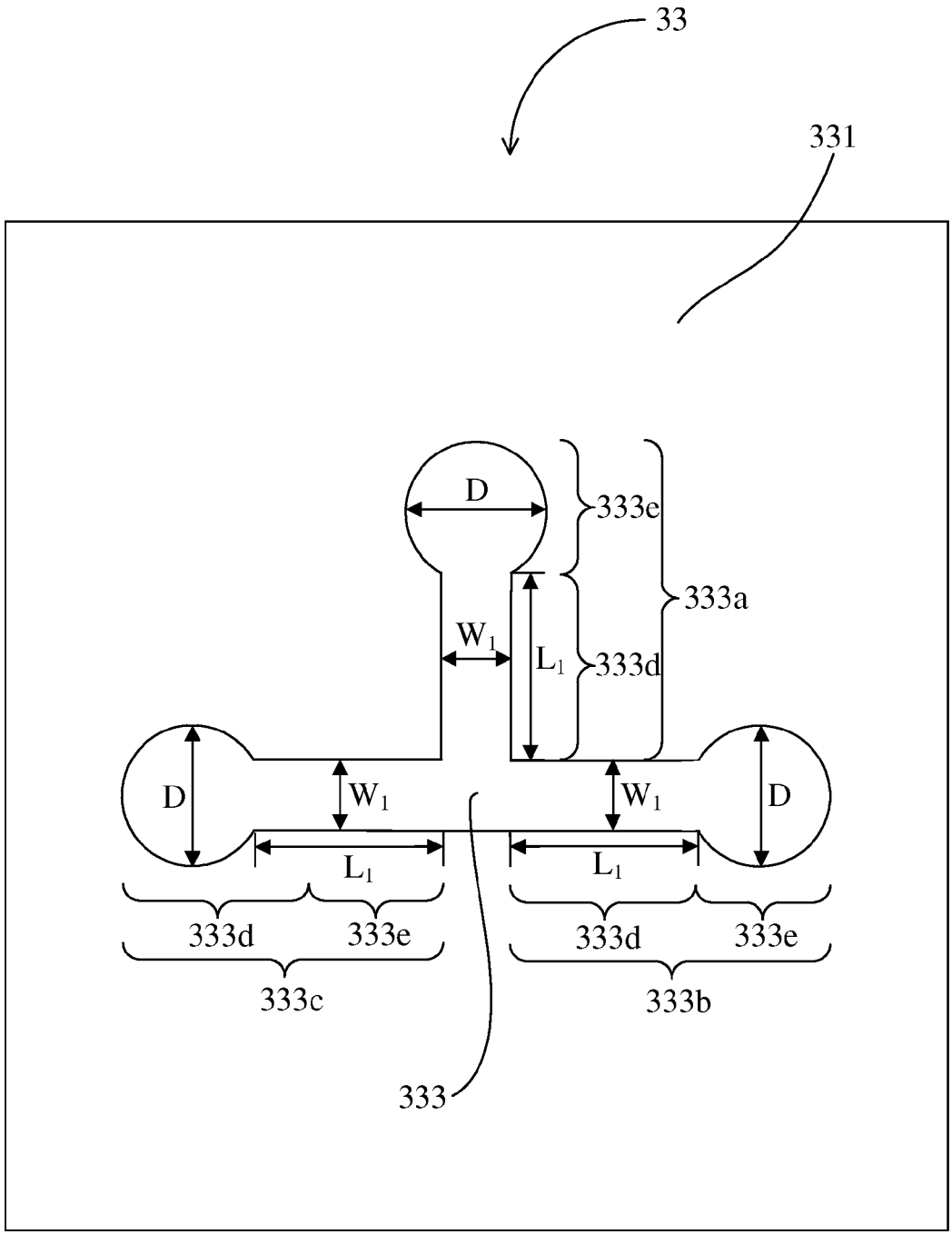
FIG. 3A is a schematic diagram illustrating the first surface of the antenna in accordance with the second embodiment.
Figure 3B:
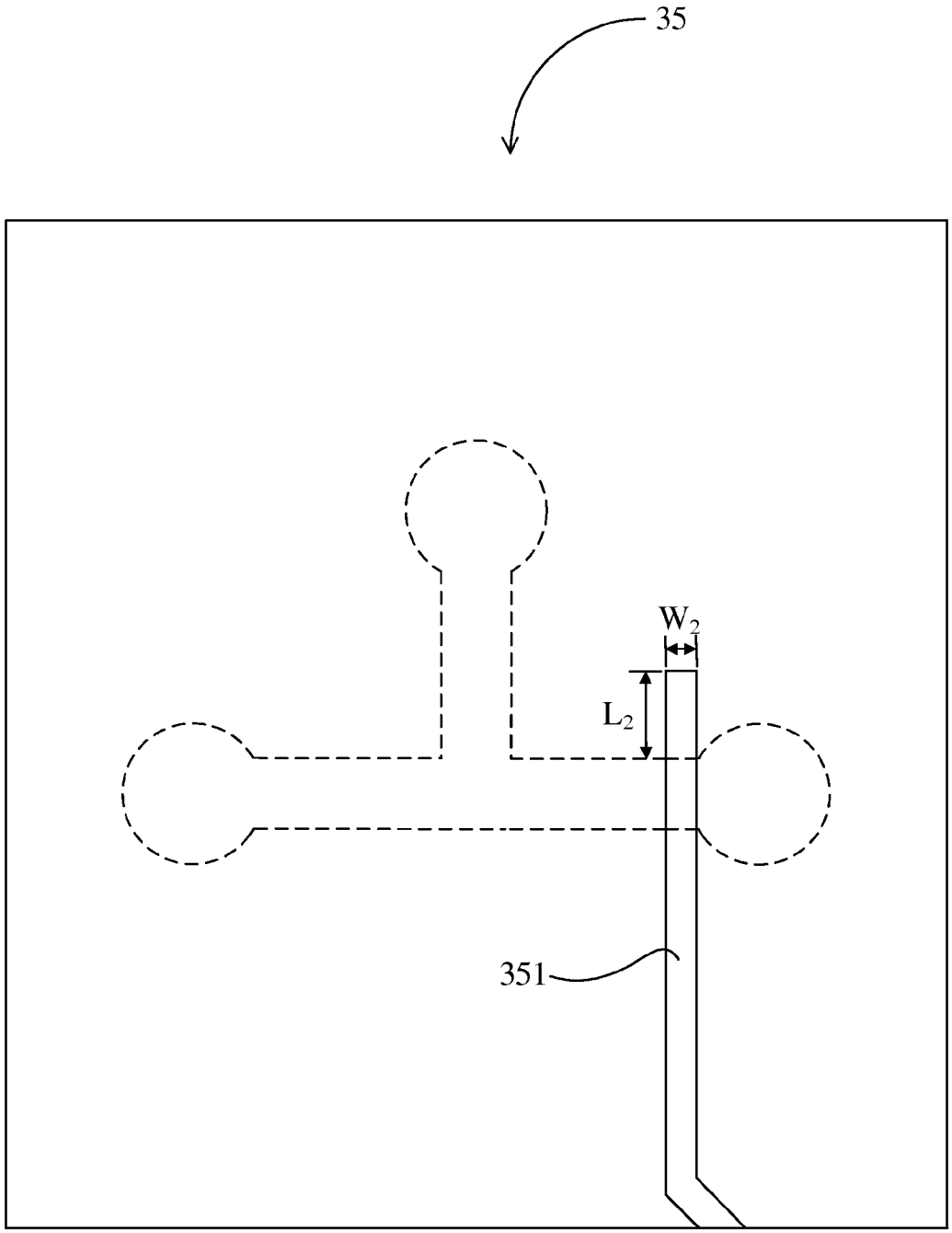
FIG. 3B is a schematic diagram illustrating the second surface of the antenna in accordance with the second embodiment.

As shown in FIGS. 3A and 3B, the antennas 3*a*, 3*b* both have a first surface 33 and a second surface 35 opposite the first surface 33. For an application with a frequency band from 880 MHz to 940 MHz, the slots 333*a*, 333*b*, and 333*c* all have the same shape in this embodiment. Each of the first areas 333*d* is shaped as a rectangle, which preferably has a length L1 of 20.2 mm and a width W1 of 7 mm. Each of the second areas 333*e* is preferred to have a radius of 9 mm. As shown in FIG. 3B, if a signal source has an impedance of 50Ω, the width W2 of the metal line 351 is preferably 3 mm, and the length L2 by which the metal line 351 protrudes beyond the opposite position is preferably 8.19 mm. Likewise, for the purpose of illustration, the relative position of the slot areas 233 is also depicted in FIG. 3B in dashed lines.

It should be noted that the antennas in the antenna array are not necessary to have the same geometric profile. For instance, an antenna 2*a* with a Y-shaped geometric profile and an antenna 3*a* with a T-shaped geometric profile may also form an antenna array. Those skilled may readily combine antennas with different geometric profiles into an antenna array upon reviewing the description of the aforesaid embodiments.

This invention provides an antenna having a slot area consisting of three slots, each of the slots extending toward a different direction individually. In this way, the problem of the prior art is solved.

The above disclosure is related to the detailed technical contents and inventive features thereof. People skilled in this field may proceed with a variety of modifications and replacements based on the disclosures and suggestions of the invention as described without departing from the characteristics thereof. Nevertheless, although such modifications and replacements are not fully disclosed in the above descriptions, they have substantially been covered in the following claims as appended.

What is claimed is:

1. An antenna, comprising:

a first surface comprising a metal area and a slot area, wherein the metal area is coated by a metal material, the slot area consists of three slots, each slot defines a first area and a second area, the first areas of the three slots are connected to each other, and the second areas of the three slots extend to different directions individually; and a second surface opposite to the first surface, wherein the second surface is coated by a metal line as a signal feed end, the metal line terminates at an opposite position of a signal feed slot, and the signal feed slot is one of the three slots.

2. The antenna of claim 1, wherein each of the first areas is a rectangle.

3. The antenna of claim 2, wherein a length of the rectangle is substantially between 20 and 21 millimeter (mm), and a width of the same is substantially between 7 and 8 mm.

4. The antenna of claim 1, wherein each of the second areas is a circle.

5. The antenna of claim 4, wherein a radius of the circle is substantially between 8 and 10 mm.

6. The antenna of claim 1, wherein the metal line terminates at an opposite position of an intersection of the first and second areas of the signal feed slot.

7. The antenna of claim 6, wherein a width of the metal line at the opposite position is substantially between 2.5 and 3.5 mm, and a terminal of the metal line protrudes beyond the opposite position by 5.5 to 9 mm.

8. The antenna of claim 1, wherein the three slots form a Y-shaped geometric profile.

9. The antenna of claim 8, wherein every two adjacent ones of the slots have an included angle of 120 degrees.

10. The antenna of claim 1, wherein the three slots form a T-shaped geometric profile.

11. An antenna system, comprising:

an antenna array comprising a plurality of antennas, each antenna comprising:

a first surface comprising a metal area and a slot area, wherein the metal area is coated by a metal material, the slot area consists of three slots, each slot defines a first area and a second area, the first areas of the three slots are connected to each other, and the second areas of the three slots extend to different directions individually; and a second surface opposite to the first surface, wherein the second surface is coated by a metal line as a signal feed end, the metal line terminates at an opposite position of a signal feed slot, and the signal feed slot is one of the three slots; and at least one plate for isolating two neighbor ones of the antennas.

12. The antenna system of claim 11, further comprising a case for accommodating the antenna array and the plate, wherein the antenna system defines a signal shield direction and a signal passing direction, a part of the case in the signal shield direction is made of metal material and a part of the case in the signal passing direction is made of non-metal material.

13. The antenna system of claim 11, wherein each of the first areas is a rectangle.

14. The antenna system of claim 13, wherein a length of the rectangle is substantially between 20 and 21 mm, and a width of the same is substantially between 7 and 8 mm.

15. The antenna system of claim 11, wherein each of the second areas is a circle.

16. The antenna system of claim 15, wherein a radius of the circle is substantially between 8 and 10 mm.

17. The antenna system of claim 11, wherein the metal line terminates at an opposite position of an intersection of the first and second areas of the signal feed slot, a width of the metal line at the opposite position is substantially between 2.5 and 3.5 mm, and a terminal of the metal line protrudes beyond the opposite position by 5.5 to 9 mm.

18. The antenna system of claim 11, wherein the three slots form a Y-shaped geometric profile.

19. The antenna system of claim 18, wherein every two adjacent ones of the slots have an included angle of 120 degrees.

20. The antenna system of claim 11, wherein the three slots form a T-shaped geometric profile.

* * * * *